US007300392B1

(12) United States Patent
Curran

(10) Patent No.: US 7,300,392 B1
(45) Date of Patent: Nov. 27, 2007

(54) BALANCE TRAINING APPARATUS

(76) Inventor: Kevin P. Curran, 1750 E. Hwy. 14, Ozark, MO (US) 65721

( * ) Notice: Subject to any disclaimer, the term of this patent is extended or adjusted under 35 U.S.C. 154(b) by 23 days.

(21) Appl. No.: 11/251,313

(22) Filed: Oct. 14, 2005

Related U.S. Application Data

(60) Provisional application No. 60/618,896, filed on Oct. 14, 2004.

(51) Int. Cl.
*A63B 22/14* (2006.01)
*A63B 22/16* (2006.01)

(52) U.S. Cl. ..... 482/146; 482/34; 482/147

(58) Field of Classification Search ..... 482/34, 482/146–147, 79–80
See application file for complete search history.

(56) References Cited

U.S. PATENT DOCUMENTS

| | | | | |
|---|---|---|---|---|
| 2,615,495 | A | 10/1952 | Hilliker | |
| 2,714,007 | A | 7/1955 | Jordan | |
| 2,803,461 | A | 8/1957 | Coplin | |
| 2,978,243 | A | 4/1961 | Gabrielson | |
| 3,024,021 | A | 3/1962 | Coplin et al. | |
| 3,298,687 | A | 1/1967 | Douglas | |
| 3,306,626 | A | 2/1967 | Kawada | |
| 3,488,049 | A | 1/1970 | Sasser, Jr. | |
| 3,604,726 | A | 9/1971 | Tracy | 280/205 |
| 3,716,229 | A | 2/1973 | Cleyen et al. | 272/57 E |
| 3,806,116 | A | 4/1974 | Malmberg et al. | 272/57 A |
| 3,862,768 | A | 1/1975 | England | 280/205 |
| 3,863,915 | A | 2/1975 | Pifer | 272/57 B |
| 3,984,100 | A | 10/1976 | Firster | 272/96 |
| 4,191,371 | A | 3/1980 | Armer, Jr. | 272/111 |
| 4,491,318 | A | 1/1985 | Francke | 272/146 |
| 4,601,469 | A | 7/1986 | Sasser, Jr. | 272/146 |
| 4,653,748 | A | 3/1987 | Seel et al. | 272/96 |
| 4,749,180 | A | 6/1988 | Boomer | 272/17 |
| 4,817,950 | A | 4/1989 | Goo | 273/148 B |
| 4,826,159 | A * | 5/1989 | Hersey | 482/146 |
| 4,966,364 | A | 10/1990 | Eggenberger | 272/111 |
| 5,048,823 | A | 9/1991 | Bean | 272/111 |
| 5,062,629 | A | 11/1991 | Vaughan | 272/97 |
| 5,152,691 | A | 10/1992 | Moscarello | 434/247 |
| 5,509,871 | A | 4/1996 | Giovanni | 482/51 |
| 5,545,115 | A | 8/1996 | Corcoran | 482/146 |
| 5,613,690 | A | 3/1997 | McShane et al. | 273/449 |
| 5,647,830 | A | 7/1997 | Tagao | 482/146 |
| D385,318 | S | 10/1997 | Videtto | D21/191 |
| 5,730,690 | A | 3/1998 | Guidry | 482/146 |

(Continued)

*Primary Examiner*—Lori Amerson
(74) *Attorney, Agent, or Firm*—Jonathan A. Bay

(57) ABSTRACT

A board for balance training has an upper footstep surface, lower bearing surface and a progressive series of concentric, cylindrical sub-frames depending from the lower surface which enclose progressively smaller framed-in areas of the bearing surface within progressively smaller framed-in crown-cavities defined by each. This progressive series ranges extremes of a major in size to minor, with none, one or more intermediates. All at least but the major sub-frame are selectively removable from the board for clearing way for progressively larger framed-in crown-cavities. Any of the sub-frames permit a training ball to roll freely sandwiched between the board and ground unless stopped against any portion of that sub-frame. Selectively utilizing a minor sub-frame over, conversely, exclusion thereof in favor of any of the progressively larger sub-frames, progressively changes the level of difficulty for trainees standing on the upper footstep surface.

12 Claims, 5 Drawing Sheets

U.S. PATENT DOCUMENTS

| | | | | |
|---|---|---|---|---|
| 5,810,703 | A | 9/1998 | Stack | 482/146 |
| 5,851,166 | A | 12/1998 | Bernardson | 482/79 |
| 5,897,474 | A | 4/1999 | Romero | 482/146 |
| 6,017,297 | A * | 1/2000 | Collins | 482/146 |
| 6,019,712 | A | 2/2000 | Duncan | 482/110 |
| 6,042,521 | A * | 3/2000 | De Giorgis | 482/79 |
| 6,168,551 | B1 | 1/2001 | McGuinness | 482/51 |
| 6,419,586 | B1 | 7/2002 | Chiu | 472/25 |
| 6,543,769 | B1 | 4/2003 | Podoloff et al. | 273/148 B |
| 6,616,583 | B1 | 9/2003 | Stack | 482/146 |
| 6,705,977 | B1 | 3/2004 | Ziak | 482/146 |
| D507,026 | S | 7/2005 | Chen | D21/671 |
| 6,916,276 | B1 | 7/2005 | Robinson | 482/51 |
| 2004/0009859 | A1 * | 1/2004 | Gottlieb | 482/146 |
| 2004/0014571 | A1 | 1/2004 | Haynes | 482/142 |
| 2004/0224824 | A1 | 11/2004 | Lickle | 482/51 |

* cited by examiner

BALANCE TRAINING APPARATUS

CROSS-REFERENCE TO PROVISIONAL APPLICATION(S)

This application claims the benefit of U.S. Provisional Application No. 60/618,896, filed Oct. 14, 2004, the specification of which is incorporated herein by this reference.

BACKGROUND AND SUMMARY OF THE INVENTION

The invention relates to balance boards and, more particularly, to balance boards in connection with people involved in balance and fitness training like surfing, windsurfing, wake boarding or skate boarding.

The prior art is replete with balance boards for balancing on balls—or in more difficult terminology, spherical rolling surfaces—with underside bearing surfaces formed as domes. E.g., U.S. Pat. No. 4,191,371—Armer, Jr. An issue with these prior art systems is that when a trainee causes the domed bearing-surface to climb up on the ball on the dome's periphery, gravity always wants to pull the board down such that the ball finds the high center.

It is an object of the invention to overcome these and other shortcomings with the prior art.

It is a further object of the invention to provide inserts to progressively make smaller the framed-in area under the board in which the training ball can operate.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
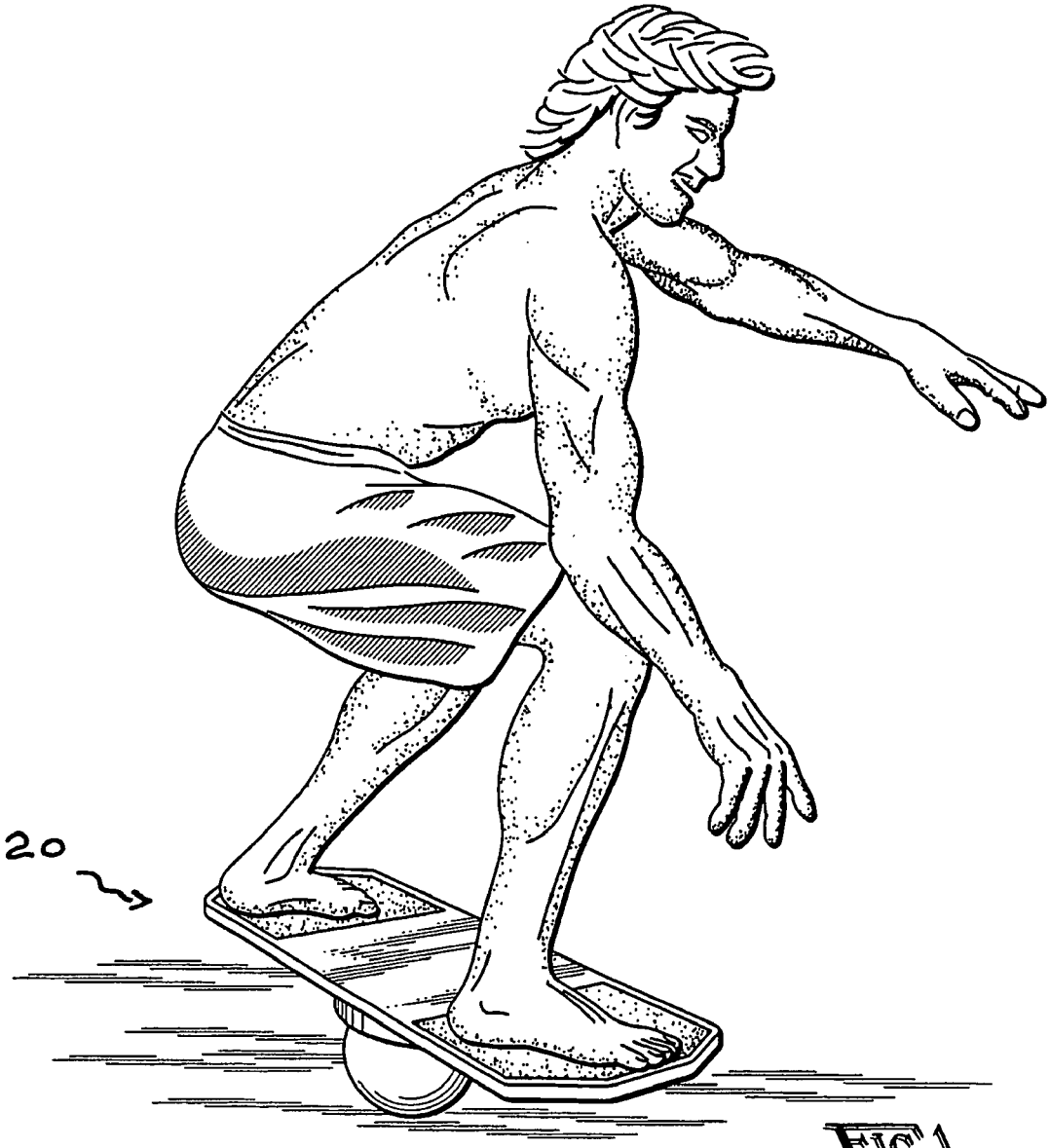
FIG. 1 is a perspective view of a balance training apparatus in accordance with the invention, wherein a trainee is illustrated to show a manner of use.
Figure 2:
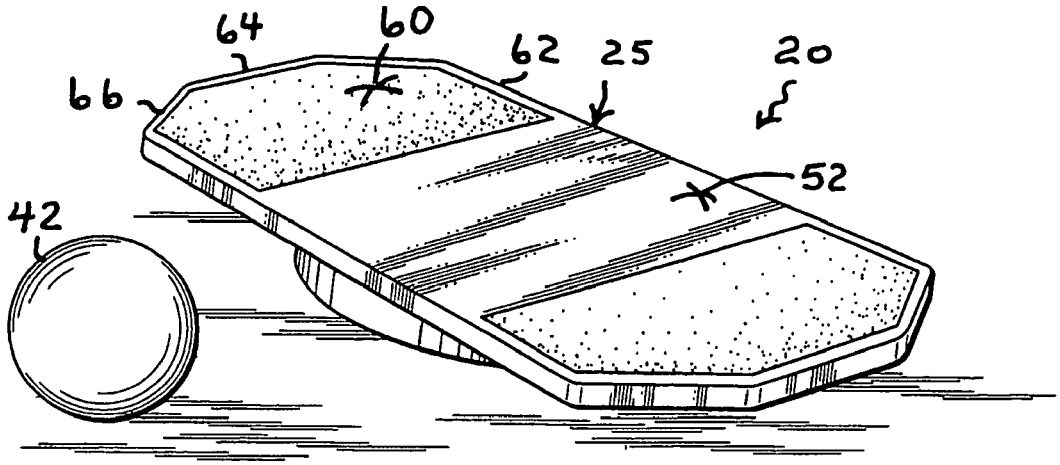
FIG. 2 is an enlarged scale perspective view thereof.

FIG. 1 shows a first embodiment of balance training apparatus 20 in accordance with the invention, with a trainee shown adopting a stance thereon for one non-limiting preferred manner of use thereof.

Figure 3:
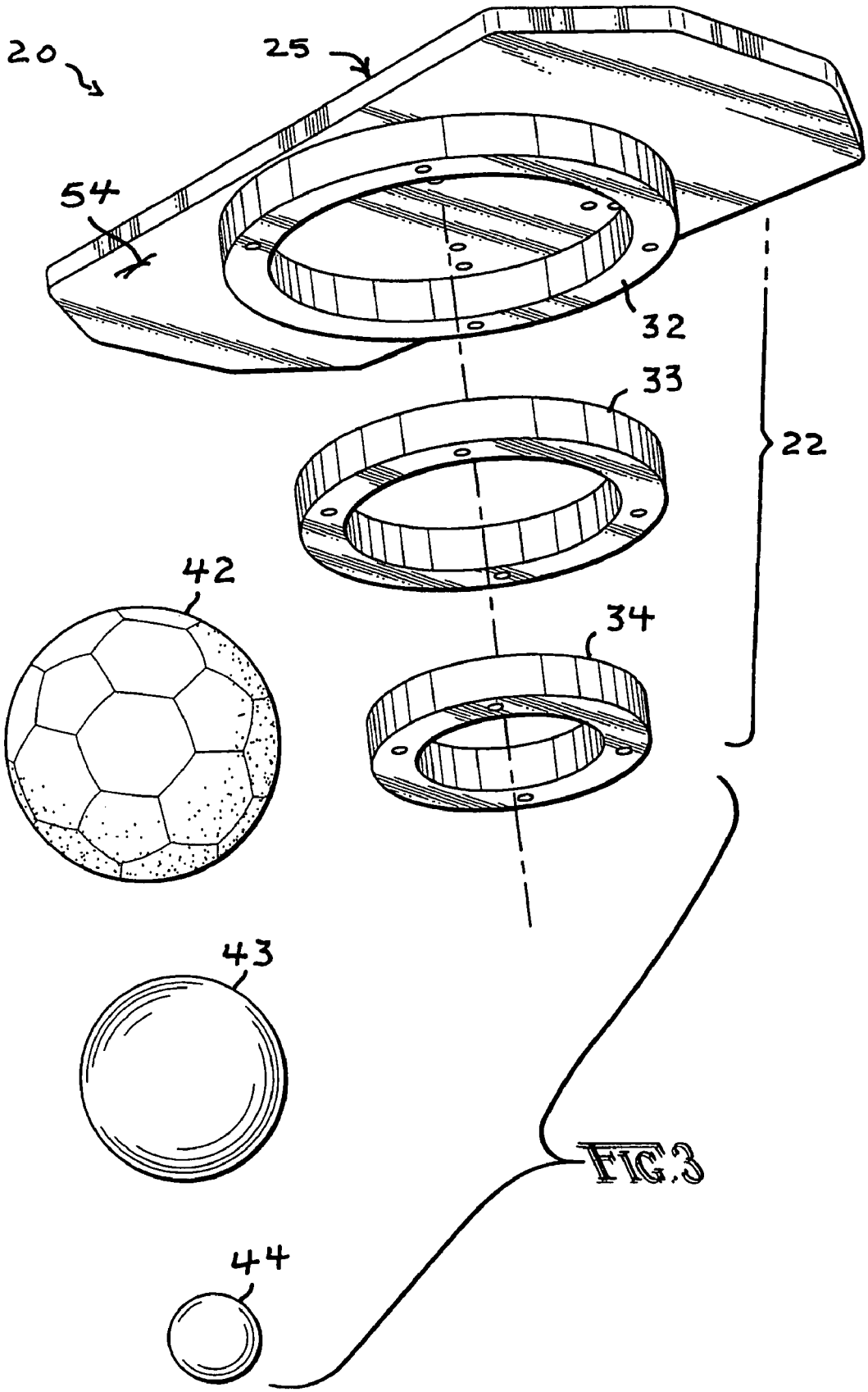
FIG. 3 is an exploded bottom perspective view thereof, except including a progressive series of difficulty-changing training balls therefor (i.e., spherical rolling fulcrums)

FIG. 3 shows that such balance training apparatus 20 in accordance with the invention comprises a balance board 22 which includes a platform 25 and progressive series of cylindrical sub-frames 32-34. Said balance training apparatus 20 further comprises a progressive series of training balls 42-44 or, again, spherical rolling fulcrums.

The platform 25 that has an upper footstep surface 52 and a lower bearing surface 54 surrounded by an edge border to be described more particularly below. The progressive series of sub-frames 32-34 have a progressive series of cylindrical inside diameters such that a major sub-frame 32 has the largest, a minor sub-frame 34 has the smallest, and an intermediate sub-frame 33 has of course an intermediate cylindrical inside diameter.

Figure 4:
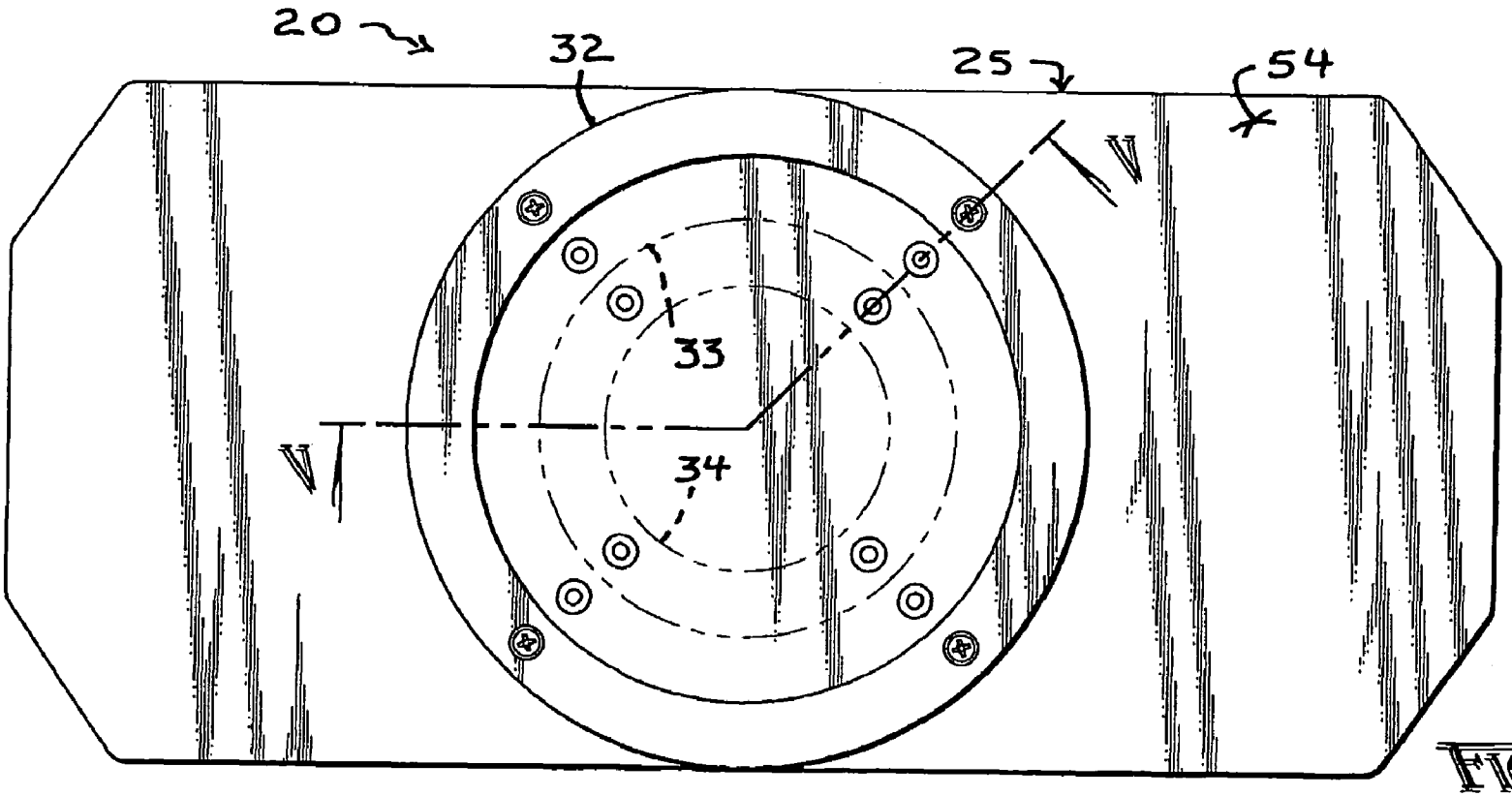
FIG. 4 is an enlarged-scale bottom plan view of the board thereof.

FIG. 4 shows that the progressive series of sub-frames 32-34 preferably nest inside each other as shown with respect to a common center. At least all but the major sub-frame 32 are removable. That is, each sub-frame 32, 33 or 34 encircles its own framed-in area of the bearing surface 54 and thereby defines its own framed-in crown cavity. For example, the major sub-frame 32 encircles a major framed-in area of the bearing surface 54 and thereby defines a major framed-in crown-cavity. Hence the minor sub-frame 34 must be removed to exposed all of the area of the bearing surface 54 framed-in by the intermediate sub-frame 33. Correspondingly, both the minor and intermediate sub-frames 34 and 33 must be removed to expose all of the area of the bearing surface 54 framed-in by the major sub-frame 32.

Figure 5:
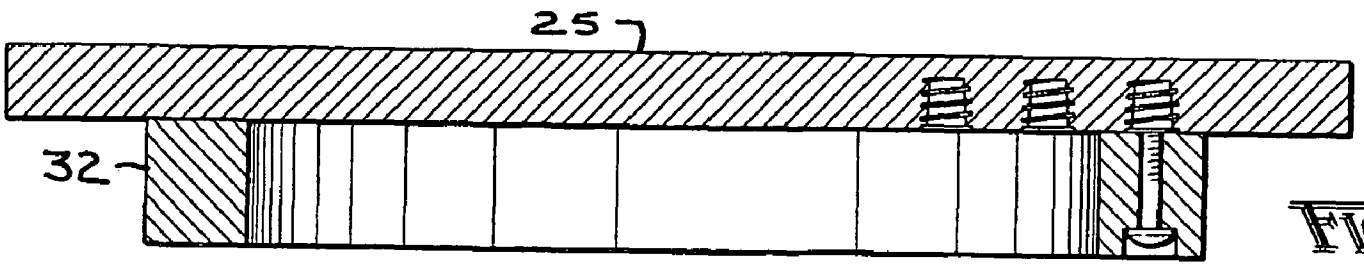
FIG. 5 is a section view taken along offset line V-V in FIG. 4.

One non-limiting example of the invention has the platform 25 constructed of plywood about one-and-one quarter inches (~3 cm) thick. Likewise the sub-frames 32-34 are constructed of plywood, to a thickness of about one-and-three quarters inches (~4½ cm) thick. FIG. 5 shows that all the sub-frames 32-34 removably attached by bolts extending up through the sub-frames 32-34 to tighten in nut inserts commonly used widely in furniture construction.

Figure 6:
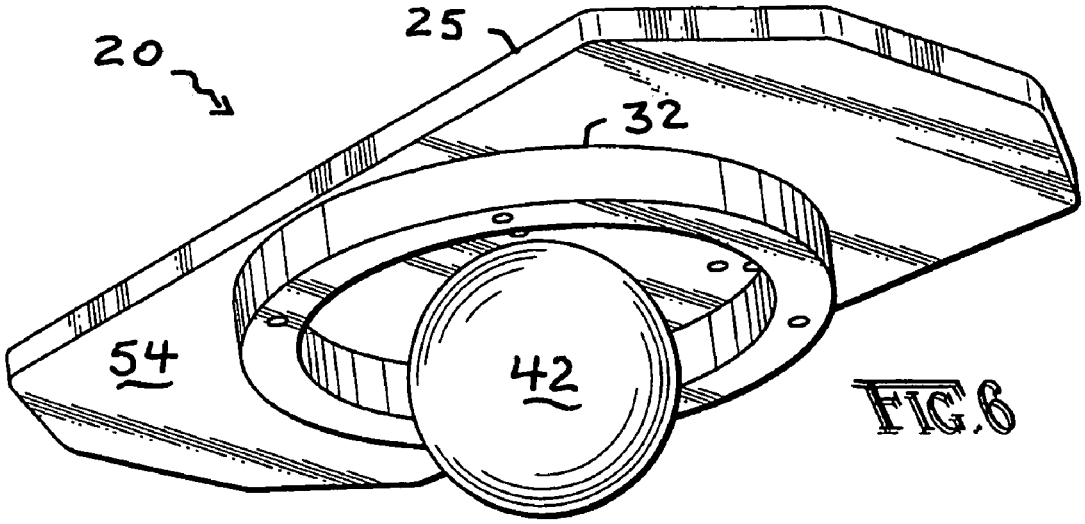
FIG. 6 is a reduced-scale bottom perspective view the FIGS. 4 and 5 version of the board combined with one selected training ball.
Figure 7:
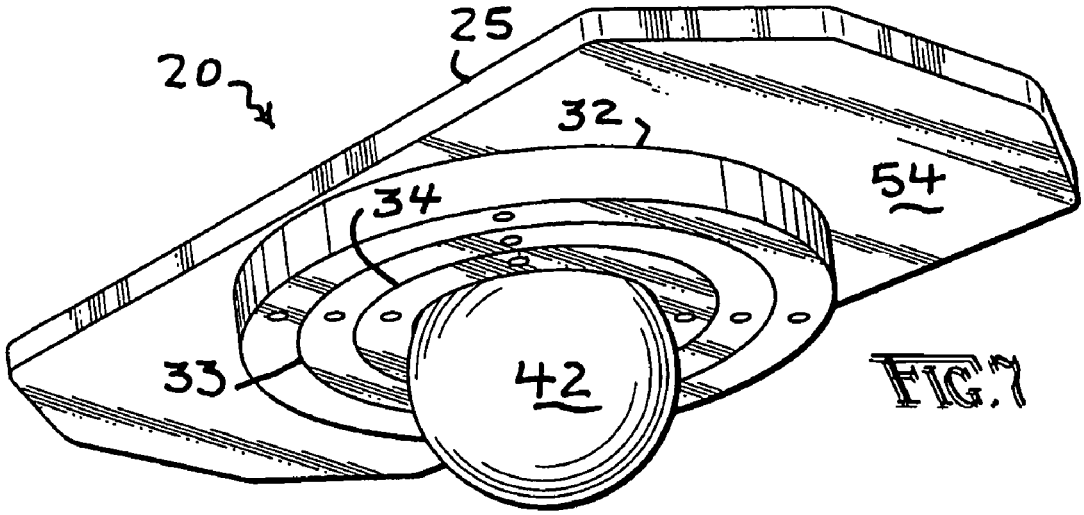
FIG. 7 is a bottom perspective view comparable to FIG. 6 except showing the size of the crown cavity for FIGS. 4 and 5 version of the board reduced in size by two progressive steps.

FIG. 6 shows the balance board 22 affixed with the major sub-frame 32 only and disposed on top of the one the spherical rolling fulcrums (e.g., 42). FIG. 7 shows the balance board 22 affixed with the minor sub-frame 34, as well as the intermediate and major sub-frames 33 and 32, which in this case add little except mass to the dynamics of the balance training apparatus 20. However, FIGS. 6 and 7 show very different interaction between the major and minor sub-frames 32 and 34 with this selected training ball 42 (i.e., spherical rolling fulcrum).

The following table provides a non-limiting example of relative dimensions for diameters (i.e., O.D. stands for outside diameter, I.D. for inside diameter) that are preferred for the progressive series of sub-frames 32-34 and training balls 42-44.

TABLE

| FRAMES | O.D. | I.D. | BALLS | O.D. |
|---|---|---|---|---|
| major | 15½" (~40 cm) | 12½" (~32 cm) | major | 7" (~18 cm) |
| intermediate | 12½" (~32 cm) | 9½" (~24 cm) | intermediate | 5" (~13 cm) |

TABLE-continued

| FRAMES | O.D. | I.D. | BALLS | O.D. |
|---|---|---|---|---|
| minor | 9½" (~24 cm) | 6½" (~16 cm) | minor | 2½" (~6 cm) |

It can be observed that the largest training ball 42 is larger than the inside diameter defined by the smallest sub-frame 34.

In use, the selected spherical rolling fulcrum 42, 43 or 44 is crowned by the platform 25 within the selected sub-frame 32, 33 or 34 such that the spherical rolling fulcrum 42, 43 or 44 is sandwiched between a ground surface and platform 25. Moreover, the spherical rolling fulcrum 42, 43 or 44 is hemmed-in by the selected sub-frame 32, 33 or 34 in order to corresponding confine its interaction with only the area of the bearing surface 54 framed-in by that selected sub-frame 32, 33 or 34 (or the respective crown-cavity thereof).

It is a generally true rule that the spherical rolling fulcrum 42, 43 or 44 is free to roll sandwiched between the platform 25 and ground surface unless stopped against any portion of the selected sub-frame 32, 33 or 34. However, FIGS. 6 and 7 show very different results from application of the foregoing rule. That is, in FIG. 7, the spherical rolling fulcrum 42 has an outside diameter greater than the minor sub-frame 34's cylindrical inside diameter. Indeed, the minor sub-frame 34 and spherical rolling fulcrum 42 are cooperatively sized such that the minor sub-frame 34 frictionally grips a circle on the spherical rolling fulcrum 42. This frictional gripping stops virtually any possibility of the spherical rolling fulcrum 42 from being able to roll in the minor framed-in area of the bearing surface 54. Accordingly, this limits the platform 25's movement relative to the ground surface to teetering and twirling. Teetering is rocking about a horizontal axis as achieved by pumping legs up and down in alternation of each other (with balance of course). Twirling is spinning about a vertical axis and is more likely achieved by twist in the torso.

Preferably, at least the major and intermediate spherical rolling fulcrums 42 and 43 are inflatable. More preferential still is to utilize novelty soccer or basketballs which are commonly available in many reduced sized compared to regulation balls used in professional sports. It is an option to provide the balance training apparatus 20 in accordance with the invention with a manual air pump as well (not shown), with an inflation needle. Inflation of the training balls 42 and 43 is achieved with the air pump, whereas deflation is best practiced by disconnecting the needle and leaking out inflated air until the training ball 42 or 43 reaches the desired level of inflation.

Consequently, is an aspect of the invention that the major training ball 42 is selectively inflatable to a selected inflation pressure in order to obtain an optimized frictional grip between the minor sub-frame 34 and major training ball 42 (i.e., major spherical rolling fulcrum).

To turn now to FIG. 6, here the major sub-frame 32 is expansively larger than the selected spherical rolling fulcrum 42's outside diameter. Therefore, utilizing the major sub-frame 32 to the exclusion of the progressively smaller sub-frames 33 or 34 frees up the chances of relative rolling between the spherical rolling fulcrum 42 and major framed-in area of the bearing surface 54, unless and until stopped by abutment against the major sub-frame 32. In consequence, this arrangement of things allows the platform 25's possible movement relative the to the ground to include translation as well as teetering and twirling. Translation is linear displacement along the ground (e.g., from one spot to another, but not necessarily in a straight line). It may be readily reckoned that there is only a limited extent of linear displacement possible before the training ball 42 limits out against the major sub-frame 32. Nevertheless, the training dynamic between the FIG. 7 arrangement of things and the FIG. 6 one is readily apparent.

The foregoing is highly desirable because this variability in the balance training apparatus 20 in accordance with the invention provides trainees with an indeterminate number of levels of training difficulty.

To turn to matters of the platform 25's planform, and its edge border, the drawings show that the platform 25 has spaced cantilevered shoulders 60 projecting oppositely beyond over not only the minor sub-frame 34 but also the major sub-frame 32. The continuations of the upper footstep surface 52 over to the shoulders 60 are fashioned with grip areas which are intended to encourage trainees to adopt a preferred stance on the platform 25. Their feet preferably would be planted on the grip areas, with legs straddling the center of the sub-frames 32-34 (e.g., the center of geometry of the platform 25 too). FIG. 1 provides illustration of one such preferred stance and/or manner of training.

Generally each shoulder 60 extends in a plane generally between spaced parallel sides 62 and a transverse end 64. However, the each shoulder 60 further comprises a pair of spaced diagonal edges 66, and these originate in the parallel sides 62 of the respective shoulder 60 and terminate in the transverse end 64. That way, these diagonal edges 66 eliminate sharp corners between the sides 62 and transverse end 64. Accordingly, trainees more safely ground out the platform 25 on the diagonal edges 66 on the ground surface than if there were sharp corners. Grounding out is considered a wipe out because if such were done in reality on a wake board, surf board, snow board or whatever, surely then the rider would have wiped out (fallen, wrecked). Conversely, stepping off the grip areas and tromping on the flanked center in order to keep one's balance is, while perhaps bad form, not always going to correspond with wiping out. In reality, perhaps such would have corresponded to some chance of recovery.

Figure 8:
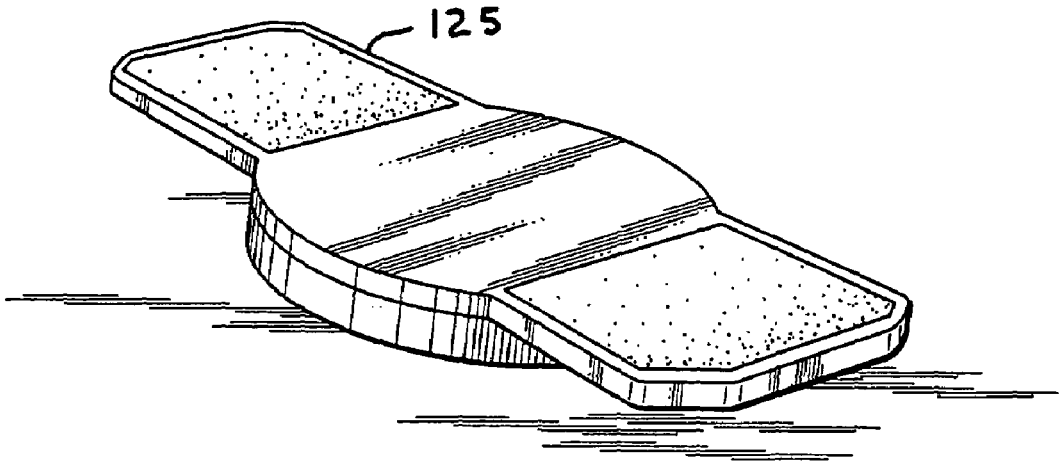
FIG. 8 is a perspective view comparable to FIG. 2 except of an alternate embodiment of a board in accordance with the invention.
Figure 9:
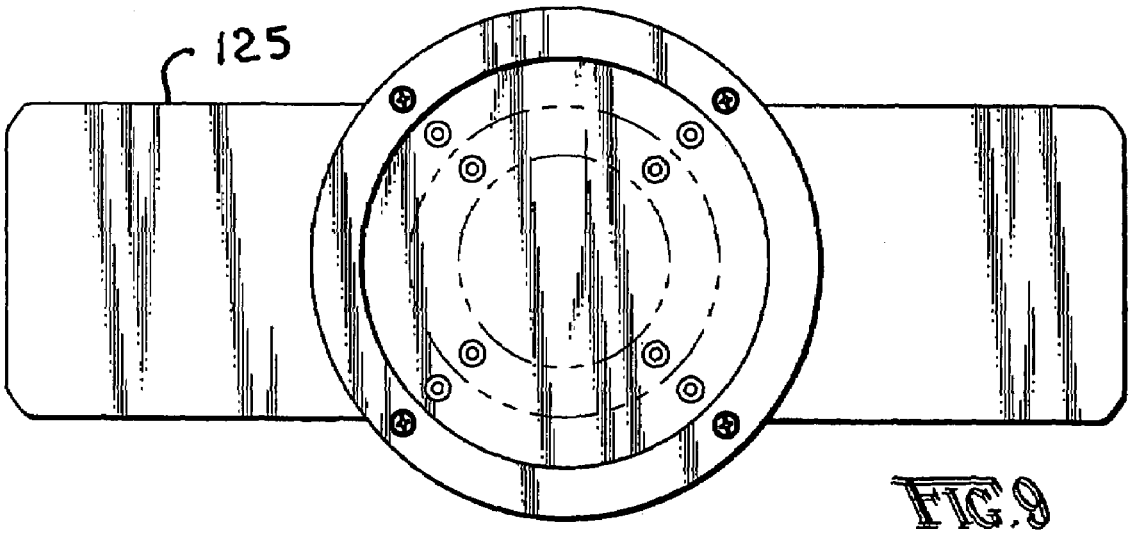
FIG. 9 is an enlarged-scale bottom plan view of FIG. 8's alternate embodiment of the board.

FIGS. 8 and 9 show an alternate embodiment of the platform 125 in accordance with the invention, one with narrower shoulders 60 and more simulative of a surfing experience on a surf board or the like.

Other matters in view of this description of the invention include a remark on what has been described here for convenience in this written description as the ground surface. The ground surface can be anything base support surface (planar or not, flat or not), including without limitation outdoor pavement, indoor tiled or carpeted or hard/soft wood floors, beach-side boardwalks, or perhaps even compacted beach sand. However, the ground surface can greatly affect the training dynamics of the balance training apparatus 20 in accordance with the invention. Needless to say, smooth pavement will provide harder experience than shag carpet, which is where perhaps novices should start.

Whereas preferably the major and intermediate training balls 42 and 43 are inflatable, it is correspondingly preferred if the minor training ball 44 has a solid construction of a suitable polymeric or resinous material.

Wherein preferably the framed-in areas of the bearing surface 54 are flat, because the training experience is totally different, the invention does not exclude a domed bearing surface (this is not illustrated). Since it is preferred to make the bearing surface 54 flat, it is a significant aspect of the invention that trainees can train first with a minor sub-frame 34 and a frictionally-captured major-size training ball 42 before progressively advancing to more difficult combinations. In the more difficult combinations of, say for example, the major sub-frame 32 and the major training ball 42 inflated hard, when a wipe out is about to occur at least the training ball 42 (or 43 and/or 44 for that matter) stops against the major sub-frame 32 to more safely terminate the failed training experience than if the sub-frame 32 (or 33 and/or 34 for that matter) were not there at all.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A balance board adapted for balance training on top of a spherical rolling fulcrum, comprising:

an upper footstep surface and a lower bearing surface; and a progressive series of hoop sub-frames adapted for depending from the bearing surface with respect to a common center of geometry and enclosing progressively smaller framed-in areas of the bearing surface, respectively, within progressively smaller framed-in crown-cavities thereby defined, respectively, ranging between extremes of a major sub-frame and a minor sub-frame;

wherein the framed-in area of the bearing surface by the major sub-frame is either flat or domed;

wherein at least all but the major sub-frame are selectively removable from the platform for clearing way for the progressively smaller framed-in crown-cavities; and whereby selectively utilizing the minor sub-frame over, conversely, exclusion thereof in favor of any of the progressively larger sub-frames, with all relatively smaller sub-frames excluded as well, progressively changes the level of difficulty for trainees standing on the upper footstep surface with the spherical rolling fulcrum crowned by the balance board within the selected sub-frame;

said sub-frames being adapted to permit said spherical rolling fulcrum to roll freely sandwiched between said balance board and a ground surface unless stopped against any portion of any sub-frame.

2. The balance board of claim 1 wherein:

the minor sub-frame is sized for adaptation to grip portions of the spherical rolling fulcrum and thus stop rolling relative the minor framed-in area of the bearing surface, whereby limiting the balance board's movement relative the ground surface to teetering and twirling.

3. A combination balance board and spherical rolling fulcrum comprising a balance board according to claim 2, wherein:

said spherical rolling fulcrum is inflatable to selective inflation pressures such that selecting a selected inflation pressure for the spherical rolling fulcrum enhances the frictional grip of the minor sub-frame on the spherical rolling fulcrum.

4. The balance board of claim 2 wherein:

the major sub-frame is sized for adaptation to the spherical rolling fulcrum such that utilizing the major sub-frame in favor of excluding the progressively smaller sub-frames frees relative rolling between the spherical rolling fulcrum and major framed-in area of the bearing surface until stopped by abutment against the major sub-frame, and thereby allows balance board movement relative the ground surface to include translation as well as teetering and twirling.

5. The balance board of claim 1 further comprising:

spaced cantilevered shoulders projecting oppositely beyond not only the minor sub-frame but also the major sub-frame, such that the upper footstep surfaces thereof comprise grip areas adapted to encourage trainees to adopt a preferred stance on the platform with feet standing on the grip areas and straddling said center of geometry of the sub-frames.

6. The balance board of claim 5 wherein:

each shoulder extends in a plane generally between spaced parallel sides and a transverse end, and further comprises a pair of spaced diagonal edges, each originating in one or the other parallel sides and terminating in the transverse end in order to eliminate sharp corners between the sides and transverse end whereby trainees more safely ground out the balance board on such diagonal edges than if there were sharp corners.

7. A balance board adapted for balance training on top of a spherical rolling fulcrum, comprising:

an upper footstep surface;

a lower surface provided with a recessed major sub-frame defining a major crown-cavity that exposes a major framed-in area of a bearing surface, which is either flat or domed; and a minor sub-frame comprising a removable insert adapted for depending from the bearing surface within the major sub-frame and enclosing a progressively smaller framed-in area of the bearing surface within a progressively smaller framed-in crown-cavity thereby defined;

whereby selectively utilizing the minor sub-frame over, conversely, exclusion thereof progressively changes the level of difficulty for trainees standing on the upper footstep surface with the spherical rolling fulcrum crowned by the balance board platform within the selected sub-frame;

said sub-frames being adapted to permit said spherical rolling fulcrum to roll freely sandwiched between said balance board and a ground surface unless stopped against any portion of any sub-frame.

8. The balance board of claim 7 wherein:

the minor sub-frame is sized for adaptation to grip portions of the spherical rolling fulcrum and thus stop rolling relative the minor framed-in area of the bearing surface, whereby limiting the balance board's movement relative the ground surface to teetering and twirling.

9. A combination balance board and spherical rolling fulcrum comprising a balance board according to claim 8, wherein:

said spherical rolling fulcrum is inflatable to selective inflation pressures such that selecting a selected inflation pressure for the spherical rolling fulcrum enhances the frictional grip of the minor sub-frame on the spherical rolling fulcrum.

10. The balance board of claim 8 wherein:

the major sub-frame is sized for adaptation to the spherical rolling fulcrum such that utilizing the major sub-frame in favor of excluding the minor sub-frame frees relative rolling between the spherical rolling fulcrum and major framed-in area of the bearing surface until stopped by abutment against the major sub-frame, and thereby allows balance board movement relative the ground surface to include translation as well as teetering and twirling.

11. The balance board of claim 7 further comprising:

spaced cantilevered shoulders projecting oppositely beyond not only the minor sub-frame but also the major sub-frame, such that the upper footstep surfaces thereof comprise grip areas adapted to encourage trainees to adopt a preferred stance on the platform with feet standing on the grip areas and straddling central axes of the sub-frames.

12. The balance board of claim 11 wherein:

each shoulder extends in a plane generally between spaced parallel sides and a transverse end, and further comprises a pair of spaced diagonal edges, each originating in one or the other parallel sides and terminating in the transverse end in order to eliminate sharp corners between the sides and transverse end whereby trainees more safely ground out the balance board on such diagonal edges than if there were sharp corners.

* * * * *